United States Patent [19]

Kelton

[11] 3,964,280

[45] June 22, 1976

[54] LOCKING MECHANISM

[75] Inventor: Grady A. Kelton, Greeneville, Tenn.

[73] Assignee: Avis Industrial Corporation, Greeneville, Tenn.

[22] Filed: Apr. 7, 1975

[21] Appl. No.: 565,392

[52] U.S. Cl. ..... 70/84; 70/237; 70/360; 70/370

[51] Int. Cl.[2] ..... E05B 27/00; E05B 65/06; E05B 65/44

[58] Field of Search ..... 70/84, 144, 145, 237, 70/240, 258, 360, 361, 370

[56] References Cited

UNITED STATES PATENTS

| | | | |
|---|---|---|---|
| 2,086,034 | 7/1937 | Jacobi | 70/360 X |
| 2,172,586 | 9/1939 | Jacobi | 70/84 |
| 2,221,095 | 11/1940 | Jacobi | 70/84 |
| 2,306,022 | 12/1942 | Lach | 70/84 X |
| 2,313,711 | 3/1943 | Jacobi | 70/84 X |
| 2,487,803 | 11/1949 | Heiman | 70/370 X |
| 2,570,556 | 10/1951 | Jacobi | 70/84 |
| 2,683,978 | 7/1954 | Jacobi | 70/360 |
| 2,743,601 | 5/1956 | Dlugatch | 70/240 |
| 2,948,141 | 8/1960 | Vahlstrom | 70/370 |
| 3,503,233 | 3/1970 | Russell et al. | 70/370 |

FOREIGN PATENTS OR APPLICATIONS

| | | | |
|---|---|---|---|
| 1,553,948 | 12/1968 | France | 20/84 |
| 1,438,551 | 4/1966 | France | 70/360 |
| 828,496 | 12/1951 | Germany | 70/370 |
| 591,461 | 8/1947 | United Kingdom | 70/360 |

*Primary Examiner*—Roy D. Frazier
*Assistant Examiner*—Thomas J. Holko
*Attorney, Agent, or Firm*—Albert L. Jeffers; Roger M. Rickert

[57] ABSTRACT

A locking mechanism for locking menbers, such as slidable or swingable closures, to another, usually stationary, member in closed position in which a bracket on the stationary member is engageable by a hook on the closure member to latch the members together while actuation of the hook into a position of disengagement from the bracket to unlock the members from each other is accomplished by a key operated push lock mechanism.

10 Claims, 8 Drawing Figures

LOCKING MECHANISM

The present invention relates to a lockable latching mechanism adapted for latching closure members, such as doors or lids, and members such as slidable drawers, in closed position while utilizing a push type lock device for actuating the parts of the latch into disengaged position.

Doors of lockers and cabinets and the like, as well as swingable lids for compartments, such as can be found on trucks and the like, and swingable and slidable doors are, in many cases, desirably locked in closed position. Many different arrangements have been arrived at for effecting the locking of such closure members in closed position, including pivoted locking elements which are rotated by a handle on the outside of the closure member, and the like.

The present invention is particularly concerned with a novel latch structure of the nature referred to which is relatively simple in construction and which, in particular, is compact and adapted readily to be incorporated in most situations requiring such a latching mechanism. Still further, the present invention is concerned with the use of a key operated push type lock mechanism for actuating the elements of the latch structure into unlatched position when the closure member is to be moved to open position.

Still further, upon releasing of the push type locking mechanism, a spring is effective for biasing the elements of the latch structure toward engaged position so that closing of the closure member will result automatically in the latching thereof and, if the key has been removed from the key operated push lock mechanism, in the locking of the closure in closed position.

An object of the present invention is the provision of a locking latch device of the nature referred to which is compact and easy to install.

Another object is the provision of a locking latch device which eliminates swingable handles and tiltable actuating plates and the like.

Still a further object is the provision of a latch device of the nature referred to which latches automatically when the member on which it is mounted is moved to closed position.

A still further object is the provision of a latch device of the nature referred to which is adapted for use in substantially any circumstance in which a closure member is to be latched to another member and locked in latched position.

BRIEF SUMMARY OF THE INVENTION

According to the present invention, a locking latch device is provided in which a lock barrel has rotatably mounted therein a key plug. The key plug is rotatable by a key between locked and unlocked positions, and when in locked position, is held against axial movement in the barrel by a lug on the key plug which engages a shoulder formed in the lock body.

When the key plug is rotated to unlocked position, an axial groove in the lock body registers with the aforementioned lug and permits axial movement of the key plug in the lock body. The lock body, at the end opposite the end of the key plug into which the key is receivable, comprises a projection on which a lever is pivotally mounted and which lever extends across the end of the key plug. The lever is spring biased toward the key plug and is movable about the pivotal support thereof when the key plug is turned to unlocked position and then pushed axially of the lock body.

The lever has a notch formed in the side which faces the key plug and an inclined cam surface or ramp leads from the notch out to the free end of the lever. The latch device is adapted for mounting on a closure such as a sliding door or the like and a bracket is mounted on the member on which the closure is movable, and when the closure is moved toward closed position, the bracket rides along the aforementioned ramp and tilts the lever outwardly so that the lever will snap back over the bracket when the closure is completely closed and whereupon, if the key plug has been rotated to locked position, the closure is locked in closed position.

The exact nature of the present invention and the objects and advantages thereof will become more apparent upon reference to the following detailed specification taken in connection with the accompanying drawings in which.

DETAILED DESCRIPTION OF THE INVENTION

Figure 1:
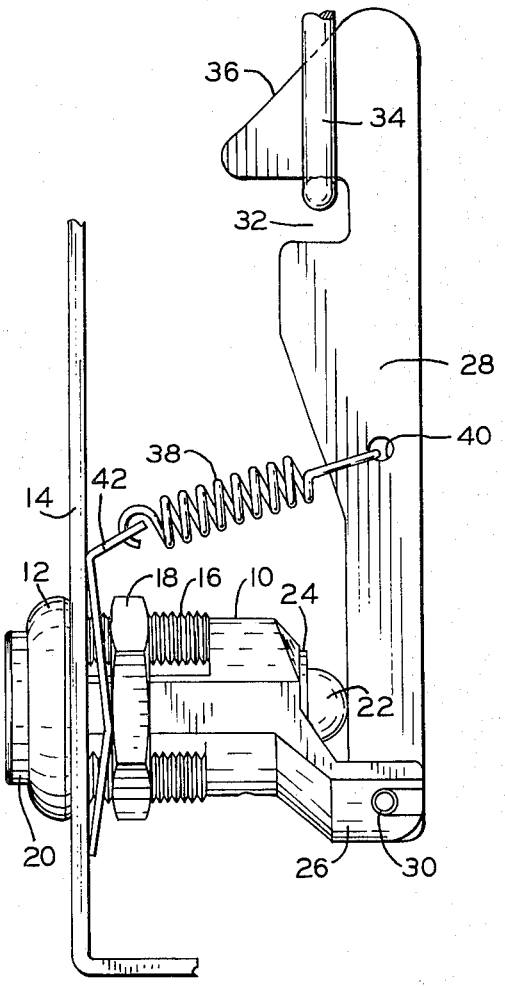
FIG. 1 is a side view of a locking latch device according to the present invention with the device mounted in a panel.
Figure 2:
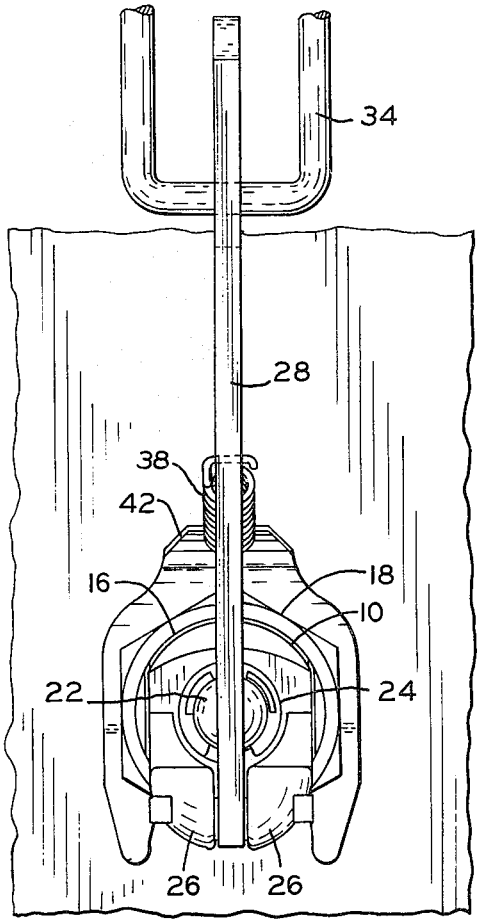
FIG. 2 is a view looking in from the right side of FIG. 1.

Referring to the drawings somewhat more in detail, the device according to the present invention comprises a lock body 10 which is formed with a radial flange 12 at one end adapted for engaging the outer side of a panel 14 which may form a portion of a closure such as a swingable or sliding door or which may form the lid of a compartment or a slidable drawer or the like.

On the inner side of panel 14, lock body 10 is provided with threads 16 and threaded thereon is a body nut 18. The lock body 10 has rotatably mounted therein a key plug having an end 20 for receiving a key by means of which the plug can be rotated in the body. End 20 is adjacent flange 12 on the outside of panel 14.

The other end of the key plug, and which is on the inner side of panel 14, has a rounded end 22 which protrudes from body 10 and which, furthermore, has thereon a snap ring or the like at 24 which abuts the inner end of body 10. Body 10 has a projection 26 thereon extending axially and radially outwardly from the body and bifurcated at the free end for receiving the end of latch lever 28 and which is pivotally connected to the projection 26 as by a roll pin 30.

Lever 28 extends across the end of the key plug and is positioned to engage the rounded end 22 of the key plug in the FIG. 1 position of the lever. Toward the free end of the lever, the lever is formed with a notch 32 extending into the lever from the side of the lever which faces the key plug for receiving a bracket element 34 which is mounted on a stationary member for which panel 14 forms the closure. Between the notch 32 and the free outer end of lever 28, the lever is formed with an inclined cam surface or ramp surface 36.

The lever 28 is biased in a counterclockwise direction as it is viewed in FIG. 1 by a spring 38 having one end connected to lever 28 as at 40 while the other end is connected to a spring clip 42 which surrounds body 10 between body nut 18 and panel 14. Preferably, the clip 42 is concave toward the panel and thereby assists in holding the device solid and vibration free in panel 14.

In operation, as the invention is illustrated in FIG. 1, panel 14 is reciprocable or swingable in such a direction as to cause lever 28 to move generally in the direction of the length thereof toward and away from bracket 34. When moving toward bracket 34, the bracket will ride up inclined surface 36 and cam the lever 28 in the clockwise direction until the notch is presented to bracket 34 whereupon the lever will be pulled back to its FIG. 1 position by spring 38. Thereafter, the lever can be moved into unlatched position only by axial movement of the key plug in lock body 10.

Figure 3:
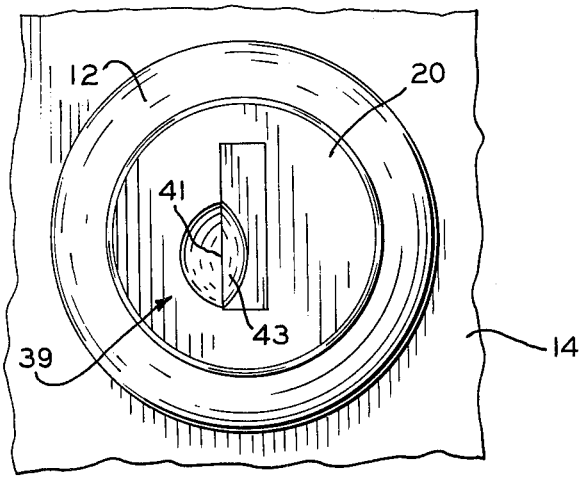
FIG. 3 is a fragmentary view looking in from the left side of FIG. 1.

As will be seen in FIG. 3, the outer end of the key plug, and which key plug is identified generally by reference numeral 39, has a key receiving slot 41 formed therein adapted for being closed by a spring loaded shutter 43 of a known type and which will seal off the key slot from moisture and the like when the device is employed in an exposed environment.

FIGS. 4 to 8 show somewhat more in detail the lock arrangement according to the present invention. As will be seen in FIG. 8, lock body 10 has axial groove means 44 formed therein for receiving the one ends of tumbler plates 46 distributed axially along the key plug and each biased toward locked position by a respective tumbler plate 48.

Figure 8:
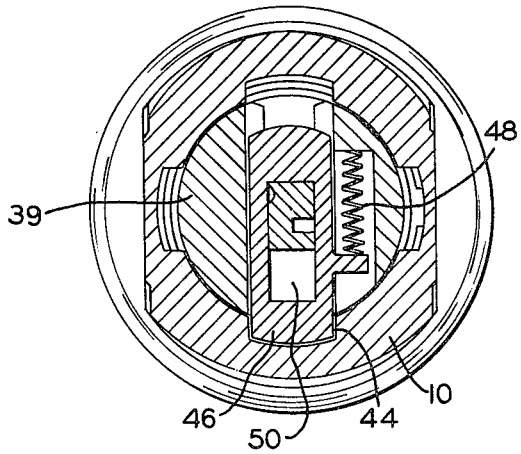
FIG. 8 is a section indicated by line VIII—VIII on FIG. 4 showing a detail in connection with the lock mechanism.
Figure 4:
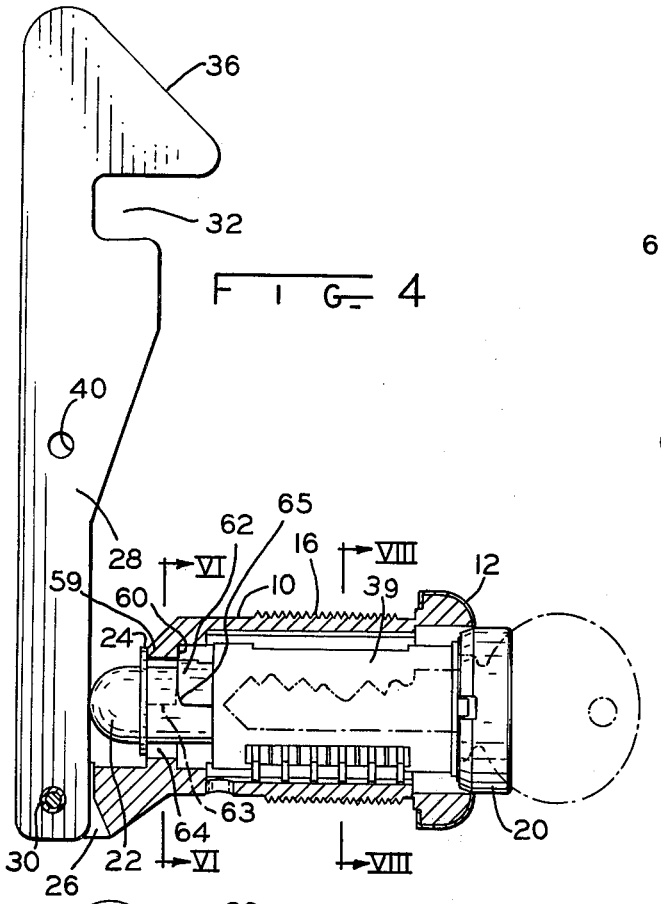
FIG. 4 is a schematic view partly in section showing the key plug in the lock body in locked position.
Figure 6:
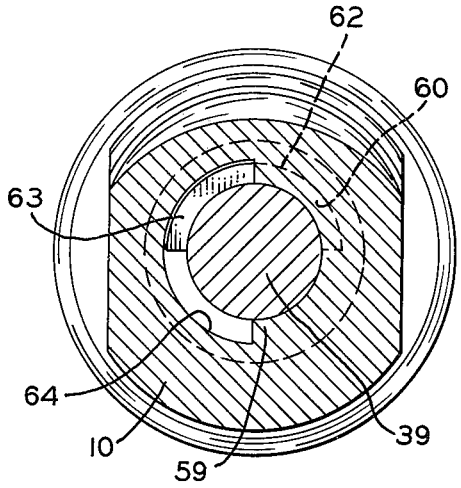
FIG. 6 is a sectional view indicated by line VI—VI on FIG. 4 showing the key plug in locked position in the lock body.
Figure 7:
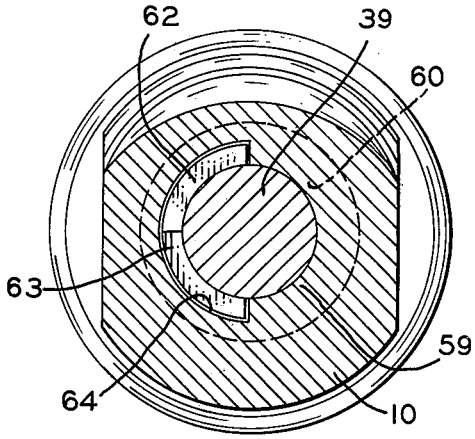
FIG. 7 is a view like FIG. 6 but shows the key plug rotated to unlocked position.

When the tumbler plates 46 are in the position shown in FIGS. 4 and 8, the key plug 39 is held against rotation in lock body 10. However, when a key is inserted in the key slot provided in the key plug, the configuration formed along the one side of the key engages the upper edges of the windows 50 formed in the tumbler plates and moves the tumbler plates into the position in which both ends thereof fall within the confines of the key plug.

Key plug 39 can then be rotated in the lock body. The locking and unlocking of the key plug in the lock body is conventional in respect of tumbler type locks and, per se, forms no part of the present invention.

According to the present invention, however, the key plug 39 is axially movable in lock body 10 when the key plug is rotated to unlock position. This comes about because the body 10 near the left end thereof as viewed in FIGS. 4 and 5 has a radial flange 59 thereon forming a shoulder 60 which faces toward the right while the key plug is formed with radially outwardly projecting lug 62 which is to the right of and in opposed relation to shoulder 60 when the key plug is in its FIG. 4 axial position.

Figure 5:
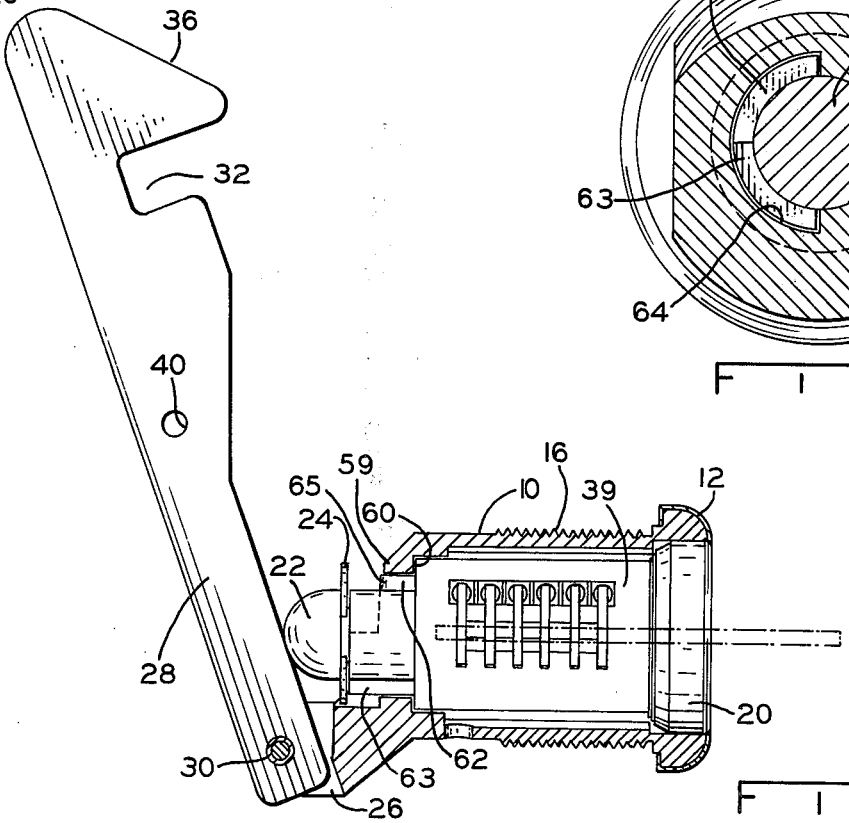
FIG. 5 is a view like FIG. 4 but shows the key plug rotated to unlocked position and moved axially to tilt the latch lever into unlocked position.

The body 10 is, furthermore, provided with an axial slot, or notch, 64 formed in the radial flange thereof and of a circumferential length at least equal to the circumferential extent of lug 62 and positioned to register with lug 62 when the key plug is rotated to its unlocked position of FIG. 5. As shown, the flange 59 at the body extends over 360° and the notch, or groove, 64 interrupts a portion of the height of the flange over a range of about 180°. The key plug, at the base of the lug 62, extends radially outwardly and forms an abutment surface to engage the flange 59 when the lock body is pushed inwardly in the lock body.

With the key plug in its FIG. 5 position, and with lug 62 registered with axial groove 64, the key plug can be pushed axially in body 10, and this will tilt latch lever 28 into unlatched position as shown in FIG. 5.

Releasing of the pressure on the key plug will, of course, permit the spring connected to lever 28 to return the lever back to its FIG. 4 position so that movement of the closure to closed position will again result in the lever latching on the bracket.

Advantageously, the key can be removed from the lock after unlocking and the key plug will be free to move axially until again locked.

The lug extends for 180° and a forwardly projecting portion 63 thereof at one side extends for 90°. Portion 63 is always disposed in groove or notch 60 and forms means for limiting the rotation of the key plug to about 90°.

The locking latch device according to the present invention is compact and simple to install and, except for the bracket which is engaged by the latch lever, is an integral unit and requires only a hole of the proper size in the closure member for mounting of the device on the closure member. All swingable actuating levers on the outside of the closure member are eliminated as well as tilt type actuating plates and the like.

The end of lug 62 which is leading when the key plug is rotated toward locked position is advantageously rounded off, or inclined, as indicated at 65 in FIG. 4, to prevent the key plug from staggering on the adjacent end of notch or groove 60 in the lock body as the key plug rotates toward locked position.

Modifications may be made within the scope of the appended claims.

What is claimed is:

1. In a lockable latch device; a lock body having a key plug rotatable and reciprocable therein, means for receiving a key in said plug at one end to unlock the plug for rotation between locked and unlocked position in the lock body, interengageable cooperating elements on said lock body and plug preventing axial movement of the plug toward the other end thereof in the lock body when in locked position including means forming a shoulder in said body and a lug on said plug which is disposed in opposed relation to said shoulder when the plug is in locked position, the end of said key plug facing the shoulder in said body being adapted to engage the shoulder when the key plug is in unlocked position and is pushed inwardly into the lock body thereby to limit the said inward movement of the key plug in the lock body, a latch lever having one end pivotally supported near said other end of the plug and extending across said other end of the plug to be engaged and pivoted thereby when the plug is moved axially in the direction of the said plug other end, said lever being mounted so that said one end is at one side of the lock body and a free end of the lever being disposed at the opposite side of the lock body, and a spring having one end connected to said lever and biasing said lever toward said other end of said plug, said body having an axial recess extending therein from the lever end of said body and registering with said lug in unlocked position of said plug.

2. A lockable latch device according to claim 1 in which said body includes a radial flange near said one end of the key plug and has threads formed thereon between said flange and the opposite end of the body, a clamp nut threaded on said body, and a clip disposed between the nut and the flange and connected to the other end of said spring.

3. A lockable latch device according to claim 1 in which said lock body and key plug comprise cooperating elements of a tumbler type lock mechanism.

4. A lockable latch device according to claim 1 in which said shoulder and axial recess are integrally formed in said lock body.

5. A lockable latch device according to claim 1 in which said recess extending over a range of 180°, said lug also extending over a range of substantially 180°, a portion of said lug at one side extending over a range of about 90° projecting forwardly from the lug and extending into the said recess and limiting rotational movement of the key plug to about 90°.

6. In a lockable latch device; a lock body having a key plug rotatable and reciprocable therein, means for receiving a key in said plug at one end to unlock the plug for rotation between locked and unlocked position in the lock body, interengageable cooperating elements on said lock body and plug preventing axial movement of the plug toward the other end thereof in the lock body when in locked position, a latch lever having one end pivotally supported near said other end of the plug and extending across said other end of the plug to be engaged thereby when the plug is moved axially in the direction of the said plug other end, said lever being mounted so that said one end is at one side of the lock body and a free end of the lever being disposed at the opposite sdie of the lock body, a spring having one end connected to said lever and biasing said lever toward said other end of said plug, said body including a projection protruding therefrom at the other end of said plug and to one side of said plug, and a pin extending through said projection and said one end of said lever and forming the pivotal support for the lever, the body having a radial mounting flange at the end opposite the lever end thereof and said projection extending axially away from and radially outwardly from said body so as to be receivable in a hole in a panel in which the body fits and is to be mounted with the flange engaging one side of the panel.

7. A lockable latch device according to claim 6 in which said cooperating elements comprise means forming a shoulder in said body and a lug on said plug which is opposed to said shoulder when the plug is in locked position, said body having an axial recess extending therein from the lever end of said body and registering with said lug in unlocked position of said plug, said plug having a ring thereon which abuts the lever end of said body when the lug on the plug is disposed in opposed relation to the shoulder in the body.

8. A lockable latch device according to claim 6 in which the lever has a lateral notch formed therein near the free end of the lever in the side of the lever which faces said plug and an incline on said side of the lever and forming a ramp along which a bracket will slide into engagement with the notch with simultaneous tilting of the lever away from said other end of the plug.

9. A lockable latch device according to claim 6 in which said lever is a flat bar in about the plane of the axis of rotation of the plug, the said other end of the plug which engages the lever when the plug is unlocked and moved axially in the lock body being rounded.

10. A lockable latch device according to claim 6 in which the said one end of the key plug into which the key is insertable protrudes axially from said lock body for convenience in moving the key plug axially in the lock body when rotated to unlocked position.

* * * * *